US009383682B1

(12) United States Patent
Ozaki et al.

(10) Patent No.: US 9,383,682 B1
(45) Date of Patent: Jul. 5, 2016

(54) DEVELOPING DEVICE INCLUDING A FIRST TRANSPORT PATH AND A SECOND TRANSPORT PATH INCLUDING A PLURALITY OF FLOW PATHS AND IMAGE FORMING APPARATUS

(71) Applicant: FUJI XEROX CO., LTD., Tokyo (JP)

(72) Inventors: Yoshifumi Ozaki, Kanagawa (JP); Chihiro Hagiwara, Kanagawa (JP); Shinji Mitsui, Kanagawa (JP); Takuya Iwamura, Kanagawa (JP); Satoshi Tanaka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/810,573

(22) Filed: Jul. 28, 2015

(30) Foreign Application Priority Data

Mar. 18, 2015 (JP) ..... 2015-055038

(51) Int. Cl.
*G03G 15/08* (2006.01)

(52) U.S. Cl.
CPC ..... *G03G 15/0887* (2013.01)

(58) Field of Classification Search
CPC ..... G03G 15/0887
USPC ..... 399/254–256, 258
See application file for complete search history.

(56) References Cited

U.S. PATENT DOCUMENTS 5,950,056 A * 9/1999 Hamamichi et al. ..... G03G 15/0822 399/256
8,559,854 B2 * 10/2013 Sasaki et al. ..... G03G 15/0822 399/254
8,989,633 B2 * 3/2015 Nakajima ..... G03G 15/0886 399/258

FOREIGN PATENT DOCUMENTS

JP 2010-164836 A 7/2010

* cited by examiner

*Primary Examiner* — William J Royer
(74) *Attorney, Agent, or Firm* — Sughrue Mion, PLLC

(57) ABSTRACT

A developing device includes a first transport path and a second transport path. In the first transport path, a developer containing toner and a magnetic material is transported in the axial direction of a first transport member that opposes a developer holding element by rotation of the first transport member. The second transport path includes plural flow paths that extend along the axial direction, and plural second transport members provided in the plural flow paths to transport the developer. The plural flow paths each have a length in the axial direction that is shorter than the length of the first transport path in the axial direction. Respective end portions of the first and second transport path are connected such that the developer which has flowed into the second transport path from one end of the first transport path flows into the other end of the first transport path.

8 Claims, 11 Drawing Sheets

DEVELOPING DEVICE INCLUDING A FIRST TRANSPORT PATH AND A SECOND TRANSPORT PATH INCLUDING A PLURALITY OF FLOW PATHS AND IMAGE FORMING APPARATUS

CROSS-REFERENCE TO RELATED APPLICATIONS

This application is based on and claims priority under 35 USC 119 from Japanese Patent Application No. 2015-055038 filed Mar. 18, 2015.

BACKGROUND

Technical Field

The present invention relates to a developing device and an image forming apparatus.

SUMMARY

According to an aspect of the present invention, there is provided a developing device including: a first transport path in which a developer containing toner and a magnetic material is transported in an axial direction of a first transport member that opposes a developer holding element by rotation of the first transport member; and a second transport path including plural flow paths that extend along the axial direction and plural second transport members provided in the plural flow paths to transport the developer, the plural flow paths each having a length in the axial direction that is shorter than a length of the first transport path in the axial direction, and respective end portions of the first transport path and the second transport path being connected such that the developer which has flowed into the second transport path from one end of the first transport path flows into the other end of the first transport path.

BRIEF DESCRIPTION OF THE DRAWINGS

Exemplary embodiments of the present invention will be described in detail based on the following figures, wherein.

DETAILED DESCRIPTION

First Exemplary Embodiment

A developing device and an image forming apparatus according to a first exemplary embodiment will be described.

[Overall Configuration]

Figure 1:
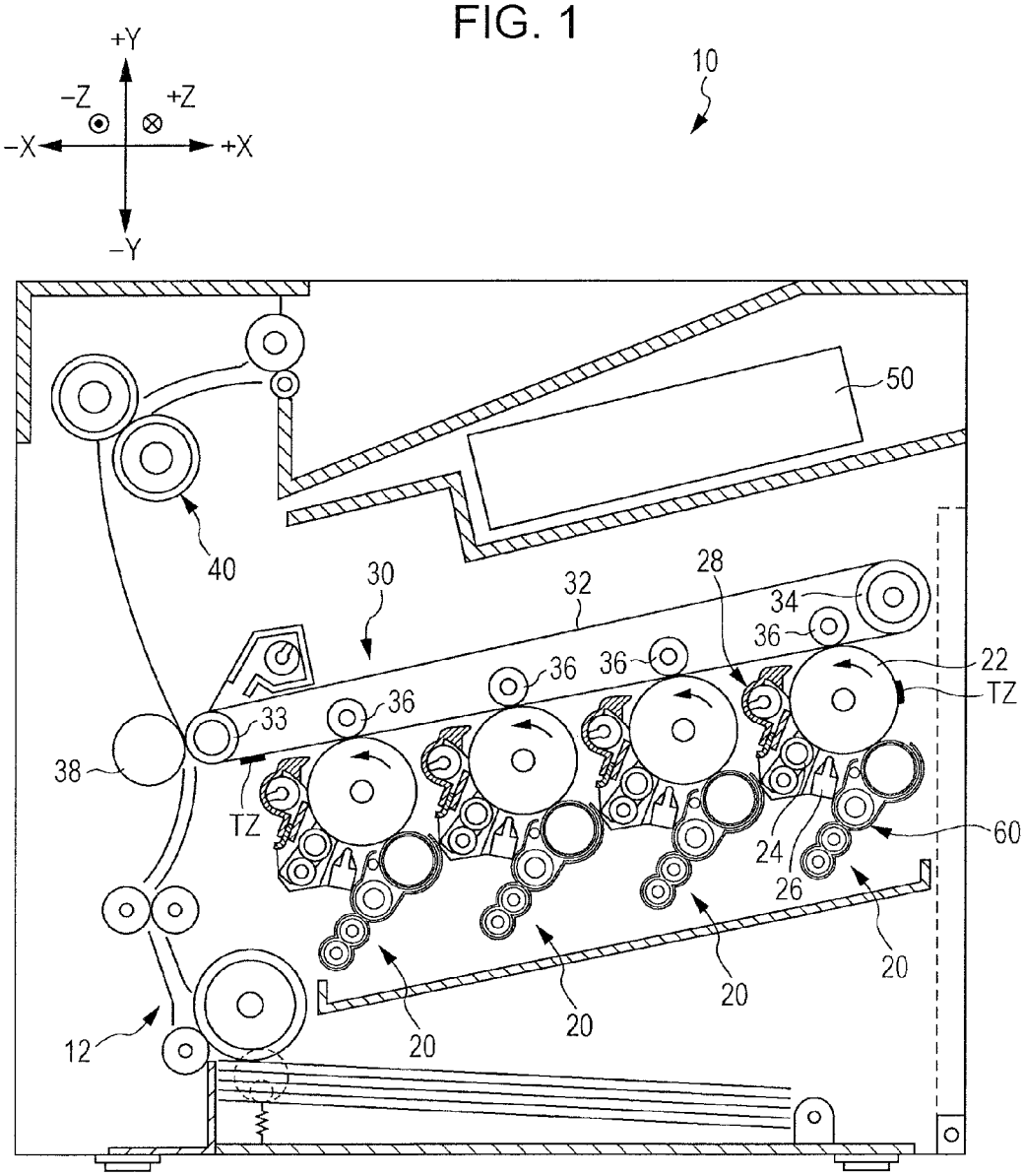
FIG. 1 illustrates the overall configuration of an image forming apparatus according to a first exemplary embodiment.

FIG. 1 illustrates an image forming apparatus 10 according to the first exemplary embodiment. The image forming apparatus 10 includes a transport portion 12 that transports paper P, four image forming units 20 that are assemblies for forming a toner image TZ, a transfer portion 30 that is an example of a transfer unit that transfers the toner image TZ to the paper P, and a fixing portion 40 that fixes the toner image TZ to the paper P. The four image forming units 20 have the same configuration as each other except for toner T (see FIG. 2) in four colors (e.g. yellow, magenta, cyan, and black) to be used.

The image forming apparatus 10 also includes a controller 50 that controls operation of the various portions. The paper P is an example of a storage medium. The toner image TZ is an example of a developer image. The toner image TZ is formed through development performed by a developing device 60 to be discussed later using a developer G (see FIG. 2).

In the following description, the apparatus width direction, the apparatus height direction, and the apparatus depth direction with the image forming apparatus 10 viewed from a user (not illustrated) standing in front of the apparatus are referred to as X direction, Y direction, and Z direction, respectively. The X direction, the Y direction, and the Z direction are orthogonal to each other. In the case where it is necessary to distinguish one side and the other side of the X direction, the Y direction, and the Z direction, the upper side and the lower side are referred to as +Y side and −Y side, respectively, the right side and the left side are referred to as +X side and −X side, respectively, and the back side and the front side are referred to as +Z side and −Z side, respectively, with the image forming apparatus 10 viewed from the front. The Y direction is an example of the direction of gravitational force. The X direction and the Z directions are examples of horizontal directions.

<Image Forming Unit>

Figure 2:
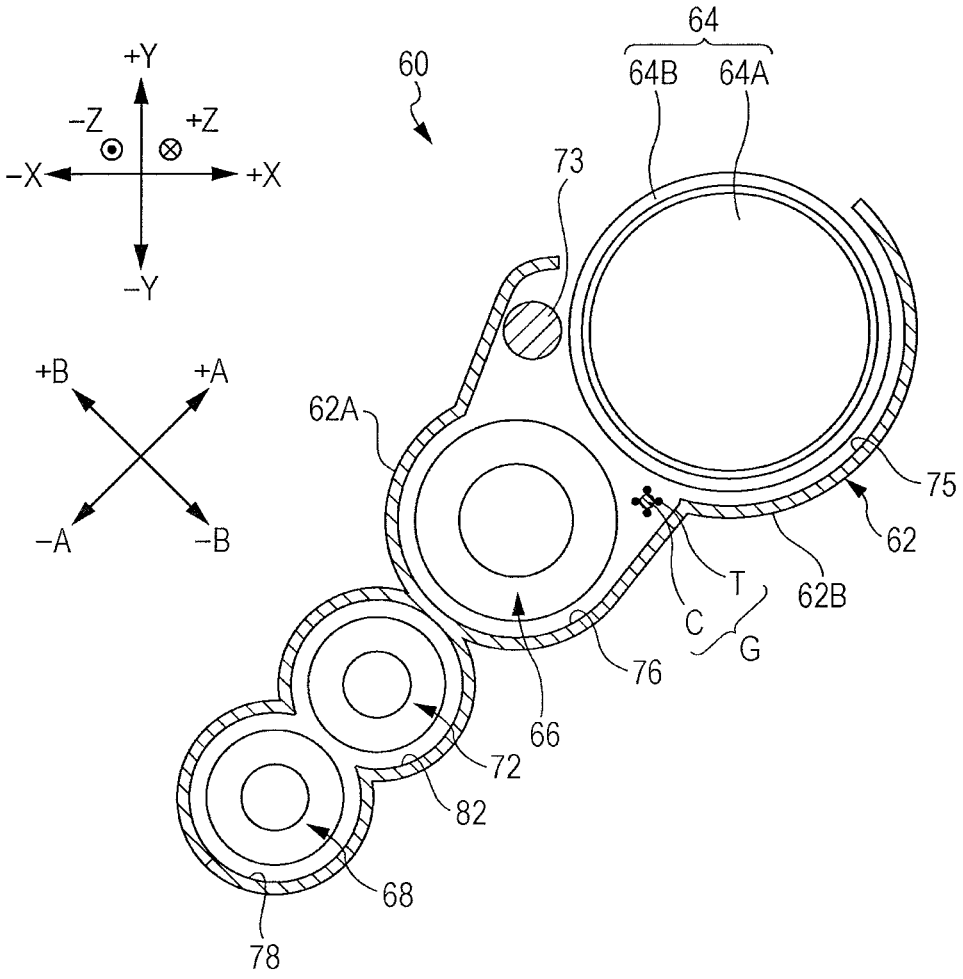
FIG. 2 illustrates the configuration of a developing device according to the first exemplary embodiment.

The image forming unit 20 illustrated in FIG. 1 includes a photosensitive body 22 that serves as an example of an image holding element, a charging roller 24 that charges the photosensitive body 22, an exposure portion 26 that exposes the charged photosensitive body 22 to light to form a latent image, and the developing device 60 which develops the latent image using the toner T (see FIG. 2). The photosensitive body 22 holds a latent image. The developing device 60 forms a toner image TZ on the outer peripheral surface of the photosensitive body 22. The image forming unit 20 further includes a cleaning unit 28 that cleans the outer peripheral surface of the photosensitive body 22. Thus, the image forming unit 20 is an electrophotographic unit that performs charging, exposure, development, and cleaning processes. The developing device 60 will be discussed in detail later.

<Transfer Portion>

As illustrated in FIG. 1, the transfer portion 30 includes a transfer belt 32 to which the toner image TZ is transferred from the photosensitive body 22, a driving roller 33 and a driven roller 34 around which the transfer belt 32 is wound, four first transfer rollers 36, and a second transfer roller 38. The first transfer rollers 36 perform a first transfer of the toner image TZ on the photosensitive body 22 to the transfer belt 32 using a potential difference from the photosensitive body 22 which is grounded. The second transfer roller 38 performs a second transfer of the toner image TZ on the transfer belt 32 to the paper P using a potential difference from the driving roller 33 which is grounded.

[Configuration of Developing Device]

Next, the developing device 60 will be described.

As illustrated in FIG. 2, the developing device 60 includes a housing 62, a developing roller 64 that serves as an example of a developer holding element, a first transport member 66, a second transport member 68, a second transport member 72, and a restriction member 73. The restriction member 73 restricts the thickness of the layer of the developer G held on the outer peripheral surface of the developing roller 64.

In FIG. 2, in order to make the members easily viewable, a part of hatching that indicates sections is not illustrated. In FIG. 2, in addition, only one particle of the developer G is illustrated as enlarged. In FIG. 2, further, the arrangement direction which is orthogonal to the Z direction and in which a first transport path 76, a first flow path 78, and a second flow path 82 to be discussed later are arranged is indicated as A direction. Moreover, the side closer to the developing roller 64 and the side farther from the developing roller 64 in the A direction are referred to as +A side and −A side, respectively. By way of example, the A direction is an oblique direction in which the +A side is on the +X side and the +Y side with respect to the −A side. Meanwhile, the direction which is orthogonal to the A direction and the Z direction is indicated as B direction. Further, the +Y side and the −Y side in the B direction are referred to as +B side and −B side, respectively.

By way of example, the developer G contains toner T to be charged to a negative polarity and a carrier C that serves as an example of a magnetic material to be charged to a positive polarity as principal components, and further contains an additive. By way of example, the toner T is made of a polyester resin.

<Housing>

As illustrated in FIG. 2, the housing 62 includes an upper wall 62A and a lower wall 62B disposed on the +B side and the −B side, respectively, with respect to the developing roller 64, the first transport member 66, the second transport member 68, and the second transport member 72. An end portion of the upper wall 62A on the −A side is coupled to an end portion of the lower wall 62B on the −A side. The housing 62 also includes a side wall 62C on the +Z side and a side wall 62D on the −Z side (see FIG. 3) to be able to accommodate the developer G inside.

Figure 3:
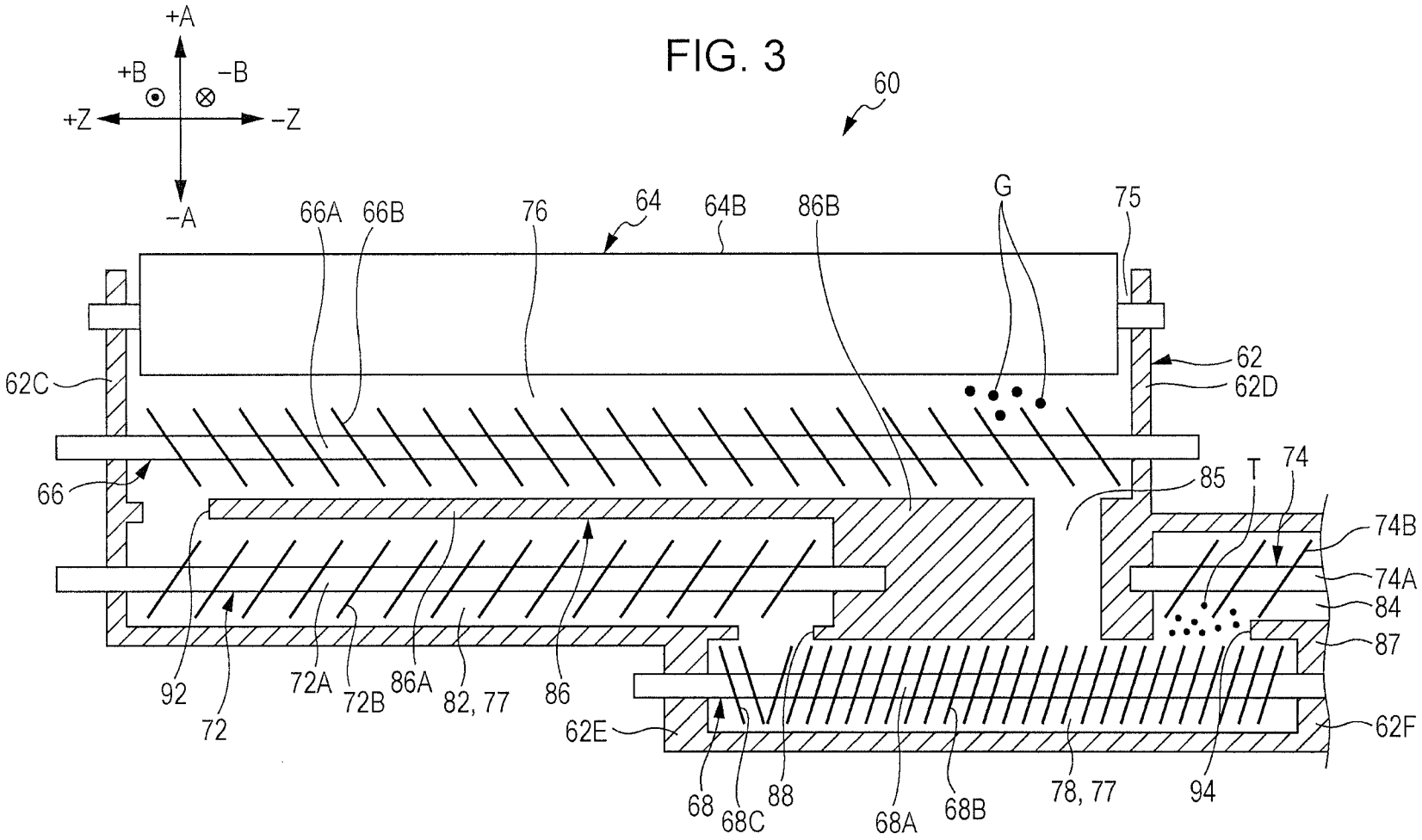
FIG. 3 is a side sectional view of the developing device according to the first exemplary embodiment.

As illustrated in FIG. 3, an accommodation chamber 75, the first transport path 76, a second transport path 77, a toner supply path 84, and a connection path 85 are formed inside the housing 62. In addition, the first transport path 76, the second transport path 77, the toner supply path 84, and the connection path 85 are partitioned by partition walls 86 and 87 formed inside the housing 62.

(Accommodation Chamber)

The accommodation chamber 75 is formed between the side wall 62C and the side wall 62D which are provided on the +A side of the housing 62 and which oppose each other in the Z direction. In addition, the accommodation chamber 75 is open on the +A side. Further, the developing roller 64 is disposed in the accommodation chamber 75. The developing roller 64 will be discussed later.

(First Transport Path)

The first transport path 76 is formed on the −A side with respect to the accommodation chamber 75, and extends along the Z direction from the side wall 62C to the side wall 62D. The developer G may flow in the A direction between the first transport path 76 and the accommodation chamber 75 over their entireties in the Z direction. The first transport member 66 is disposed inside the first transport path 76. The first transport member 66 will be discussed later. The partition wall 86 is formed on the −A side with respect to the first transport path 76.

The partition wall 86 is provided between the side wall 62C and the side wall 62D of the housing 62 and at the center portion in the A direction to extend in the Z direction. In addition, the partition wall 86 includes a plate-like first wall portion 86A that extends from the center portion in the Z direction to a location near the side wall 62C, and a second wall portion 86B that is wider in the A direction than the first wall portion 86A and that extends from an end portion of the first wall portion 86A on the −Z side to a location near the side wall 62D. A surface of the first wall portion 86A on the +A side and a surface of the second wall portion 86B on the +A side are flush with each other in the Z direction. The connection path 85 is formed on the −Z side with respect to the second wall portion 86B.

(Connection Path)

The connection path 85 extends along the A direction, and an end portion of the connection path 85 on the +A side is connected to an end portion of the first transport path 76 on the −Z side. In addition, an end portion of the connection path 85 on the −A side is connected to the first flow path 78 to be discussed later. This enables the developer G in the first transport path 76 to pass through the connection path 85 to move (flow) into the first flow path 78.

(Second Transport Path)

The second transport path 77 includes the first flow path 78 and the second flow path 82 which serve as an example of plural flow paths.

The first flow path 78 is provided on the −A side with respect to the second wall portion 86B to extend along the Z direction. In addition, the length of the first flow path 78 in the Z direction is shorter than the length of the first transport path 76 in the Z direction. An end portion of the first flow path 78 on the +Z side extends to a location on the +Z side with respect to the second wall portion 86B as seen in the A direction. Further, an end portion of the first flow path 78 on the −Z side extends to a location on the −Z side with respect to the side wall 62D as seen in the A direction. The connection path 85 is connected to a portion of the first flow path 78 on the −Z side with respect to the center portion in the Z direction.

Moreover, a first opening 88 that penetrates in the A direction is formed at an end portion of the first flow path 78 on the +Z side and on the +A side. In addition, a third opening 94 that serves as an example of an opening portion that penetrates in the A direction is formed at an end portion of the first flow path 78 on the −Z side (an end portion on the −Z side with respect to the connection path 85 as seen in the A direction) and on the +A side. The second transport member 68 is disposed inside the first flow path 78. The second transport member 68 will be discussed later.

The second flow path 82 is provided on the −A side with respect to the first wall portion 86A and on the +Z side with respect to the second wall portion 86B to extend along the Z direction. In addition, the length of the second flow path 82 in the Z direction is shorter than the length of the first transport path 76 in the Z direction. An end portion of the second flow path 82 on the −Z side is disposed on the +A side (on the side closer to the first transport path 76) with respect to an end portion of the first flow path 78 on the +Z side. That is, an end portion of the first flow path 78 on the +Z side and an end portion of the second flow path 82 on the −Z side are disposed so as to overlap each other as seen in the A direction. Further, an end portion of the second flow path 82 on the −Z side is connected so as to enable movement of the developer G to an end portion of the first flow path 78 on the +Z side via the first opening 88.

An end portion of the second flow path 82 on the +Z side extends to the side wall 62C. In addition, a second opening 92 provided on the +Z side with respect to the first wall portion 86A to penetrate in the A direction is formed in an inner wall at an end portion of the second flow path 82 on the +Z side and on the +A side. That is, an end portion of the second flow path 82 on the +Z side is connected to an end portion of the first transport path 76 on the +Z side via the second opening 92. The second transport member 72 is disposed inside the second flow path 82. The second transport member 72 will be discussed later.

In this way, respective end portions of the first flow path 78 and the second flow path 82 are disposed so as to overlap each other in the Z direction (as seen in the A direction). The first flow path 78 and the second flow path 82 are formed such that the developer G which has flowed in from one end of the first transport path 76 flows to the other end of the first transport path 76. In addition, the second flow path 82 is disposed closer to the first transport path 76 than the first flow path 78 in the A direction. The phrase "arrangement in which respective end portions of two rotatable members overlap each other in the axial direction" means an arrangement in which, when one of two members having rotational axes extending in the same axial direction and not provided on the same line is projected toward the rotational axis of the other, end portions of the two members overlap each other in the projected region. In other words, the phrase means that two members having rotational axes extending in the same axial direction and not provided on the same line are arranged in one (arrangement direction) of directions that are orthogonal to the axial direction, and that end portions of the two members overlap each other when the two members are seen in the arrangement direction.

(Toner Supply Path)

The toner supply path 84 extends along the Z direction toward the −Z side from a position on the +A side with respect to the third opening 94 and on the −Z side with respect to the connection path 85. As seen in the Z direction, in addition, the toner supply path 84 is provided on the +A side with respect to the first flow path 78, and disposed at substantially the same position as the second flow path 82. A toner transport member 74 is disposed inside the toner supply path 84. The toner transport member 74 will be discussed later.

<Developing Roller>

The developing roller 64 illustrated in FIG. 2 includes a magnet roller 64A fixed to the housing 62 and having an axis extending in the Z direction, and a developing sleeve 64B rotatably supported on the outer side of the magnet roller 64A coaxially with the magnet roller 64A.

<First Transport Member>

The first transport member 66 illustrated in FIG. 3 includes a shaft portion 66A having an axis extending in the Z direction, and a spiral blade portion 66B formed on the outer periphery of the shaft portion 66A. One end of the shaft portion 66A is rotatably supported by the side wall 62D. The other end of the shaft portion 66A is rotatably supported by the side wall 62C. The first transport member 66 transports the developer G toward the −Z side when the shaft portion 66A is rotated. In addition, the first transport member 66 opposes the developing sleeve 64B in the A direction. In the first exemplary embodiment and second and third exemplary embodiments to be discussed later, the shaft portion 66A of the first transport member 66 is thicker than the shaft portion of each of the second transport members 68, 72 so that the center portion of the first transport member 66 in the Z direction is unlikely to be warped compared to each of the second transport members 68, 72.

<Second Transport Member>

As illustrated in FIG. 3, the second transport member 68 includes a shaft portion 68A having an axis extending in the Z direction, a spiral blade portion 68B formed on the outer periphery of the shaft portion 68A, and an inverted blade portion 68C formed on the outer periphery of an end portion of the shaft portion 68A on the +Z side to transport the developer G toward the opposite side compared to the blade portion 68B. The inverted spiral blade portion 68C suppresses residence of the developer G at an end portion of the first flow path 78 on the +Z side. One end of the shaft portion 68A is rotatably supported by a side wall 62F formed at an end portion of the housing 62 on the −A side. The other end of the shaft portion 68A is rotatably supported by a side wall 62E formed at an end portion of the housing 62 on the −A side. The length of the shaft portion 68A in the Z direction is shorter than the length of the shaft portion 66A in the Z direction. The second transport member 68 transports the developer G toward the +Z side when the shaft portion 68A is rotated.

The second transport member 72 includes a shaft portion 72A having an axis extending in the Z direction, and a spiral blade portion 72B formed on the outer periphery of the shaft portion 72A. One end of the shaft portion 72A is rotatably supported by the second wall portion 86B. The other end of the shaft portion 72A is rotatably supported by the side wall 62C. In addition, the length of the shaft portion 72A in the Z direction is shorter than the length of the shaft portion 66A in the Z direction. The second transport member 72 transports the developer G toward the +Z side when the shaft portion 72A is rotated.

As illustrated in FIG. 2, by way of example, the outside diameter of the spiral blade portion 68B of the second transport member 68 and the outside diameter of the spiral blade portion 72B of the second transport member 72 are substantially the same as each other. In addition, by way of example, the outside diameter of the second transport member 68 and the outside diameter of the second transport member 72 are each smaller than the outside diameter of the first transport member 66.

The projected area in the Z direction corresponding to one rotation of the spiral blade portion 68B of the second transport member 68 illustrated in FIG. 3 is defined as S1, the pitch which is the length in the Z direction corresponding to one rotation of the spiral blade portion 68B is defined as P1, and the rotational speed which is the number of rotation of the second transport member 68 per unit time is defined as R1. In addition, the projected area in the Z direction corresponding to one rotation of the spiral blade portion 72B of the second transport member 72 is defined as S2, the pitch which is the length in the Z direction corresponding to one rotation of the spiral blade portion 72B is defined as P2, and the rotational speed which is the number of rotation of the second transport member 72 per unit time is defined as R2. S1, S2, P1, P2, R1, and R2 are not illustrated.

The flow rate (volume flow rate) of the developer G due to rotation of the second transport member 68 is defined as V1. Then, V1 may be represented through approximation as V1=S1×□P1×□R1. The flow rate (volume flow rate) of the developer G due to rotation of the second transport member 72 is defined as V2. Then, V2 may be represented through approximation as V2=S2×□P2×□R2. In order to suppress clogging of the flow path with the developer G, it is desirable that V1=V2 should be met. That is, it is desirable that S1×□P1×□R1=S2×□P2×□R2 should be met. If the flow rate in the first transport member 66 is defined as V3, it is desirable that V1=V2=V3 should be met.

In the exemplary embodiment, by way of example, S1=S2, P1=P2/2, and R1=2×□R2 are met. That is, the pitch P1 of the second transport member 68 is determined as one-half the pitch P2 of the second transport member 72, and the rotational speed R1 of the second transport member 68 is determined as twice the rotational speed R2 of the second transport member 72, which increases the rotational speed R1 of the second transport member 68 without varying the flow rate.

<Toner Transport Member>

As illustrated in FIG. 3, the toner transport member 74 includes a shaft portion 74A having an axis extending in the Z direction, and a spiral blade portion 74B formed on the outer periphery of the shaft portion 74A. One end of the shaft portion 74A is rotatably supported by a side wall (not illustrated). The other end of the shaft portion 74A is rotatably supported by a portion of the side wall 62D that swells on the −A side. The toner transport member 74 transports the toner T supplied from a toner cartridge (not illustrated) toward the +Z side when the shaft portion 74A is rotated.

In the developing device 60, the developing sleeve 64B, the first transport member 66, the second transport member 68, the second transport member 72, and the toner transport member 74 are rotated about their own axes by rotationally driving a gear (not illustrated) provided at an end portion in the axial direction using a motor (not illustrated). In addition, the developer G in the first transport path 76 is transported (circulated) in the order of the connection path 85, the first flow path 78, the first opening 88, the second flow path 82, the second opening 92, and the first transport path 76 by rotation of the first transport member 66, the second transport member 68, and the second transport member 72.

[Effect]

Next, the effect of the first exemplary embodiment will be described.

Figure 4:
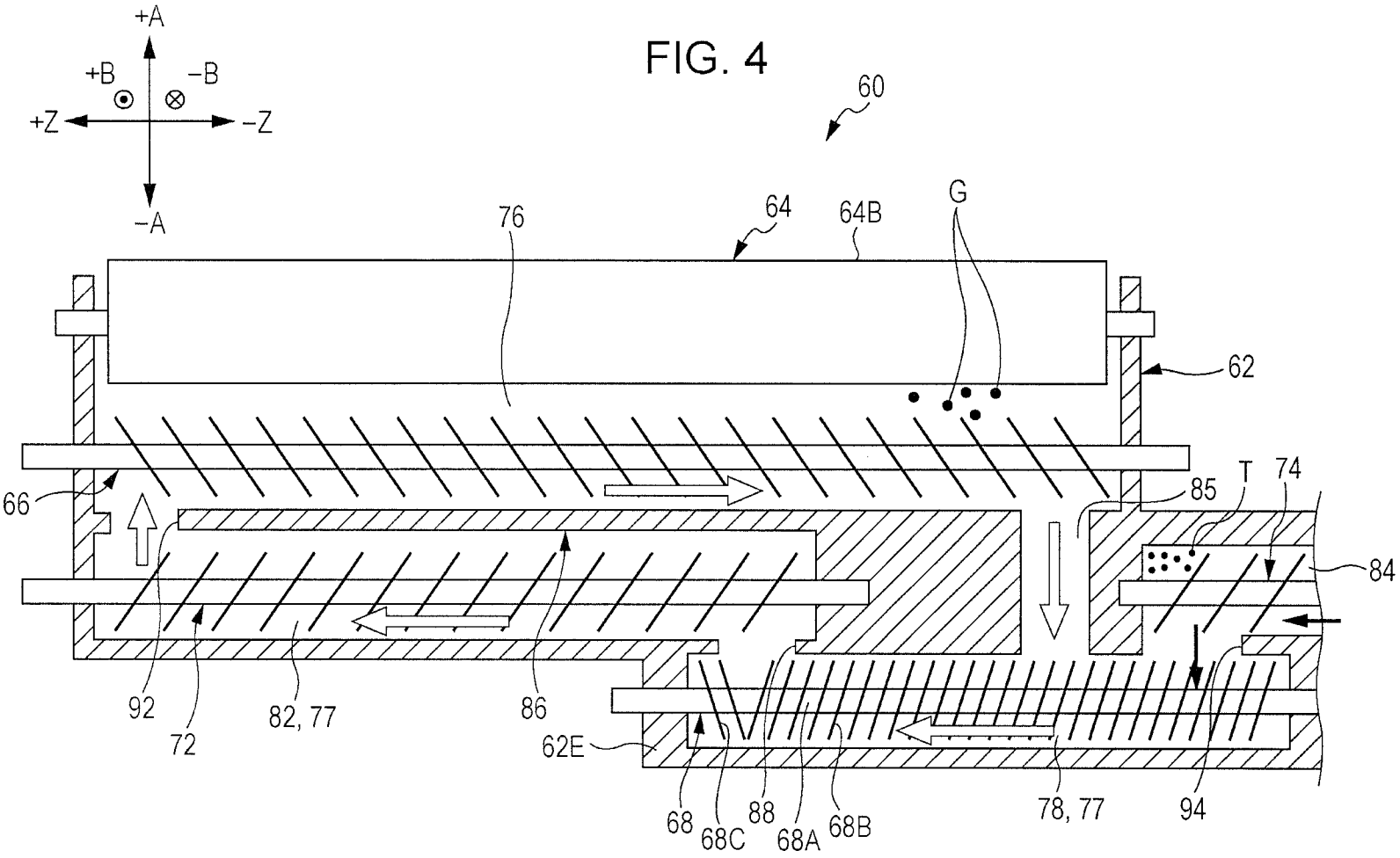
FIG. 4 illustrates the flow of a developer and toner inside the developing device according to the first exemplary embodiment.

In the developing device 60 illustrated in FIG. 4, when the first transport member 66, the second transport member 68, the second transport member 72, and the toner transport member 74 are rotated, the developer G in the first transport path 76 passes through the connection path 85 to flow into the first flow path 78. In this event, the developer G passing through the connection path 85 has a reduced concentration (toner concentration) of the toner T in the developer G compared to the developer G before development because the toner T has been consumed during the development.

Meanwhile, the toner T in the toner supply path 84 passes through the third opening 94 to flow into (be supplied to) the first flow path 78. In the first flow path 78, the developer G with a reduced toner concentration and the supplied toner T are stirred and transported toward the +Z side by rotation of the second transport member 68. In FIG. 4, the flow of the developer G is indicated by the white arrows, and the flow of the toner T is indicated by the black arrows.

Compared to the second transport member 72, the second transport member 68 has a shorter pitch P1 and a higher rotational speed R2, and thus has more contact between the spiral blade portion 68B and the developer G (the toner T and the carrier C (see FIG. 2)). Therefore, the charge amount of the developer G due to contact between the toner T and the carrier C is increased compared to a configuration in which the second transport member 68 and the second transport member 72 have the same pitch and the same rotational speed as each other.

Subsequently, the developer G transported to an end portion of the first flow path 78 on the +Z side contacts a side surface of the side wall 62E on the −Z side to be prevented from moving in the Z direction. Consequently, the developer G is deposited at an end portion of the first flow path 78 on the +Z side. A part of the deposited developer G passes through the first opening 88 to flow into an end portion of the second flow path 82 on the −Z side. Then, the developer G which has flowed into the second flow path 82 is further stirred and transported to an end portion of the second flow path 82 on the +Z side by rotation of the second transport member 72, and passes through the second opening 92 to flow into an end portion of the first transport path 76 on the +Z side. The developer G which has flowed into an end portion of the first transport path 76 on the +Z side is supplied to the outer peripheral surface of the developing sleeve 64B while being transported toward the −Z side by rotation of the first transport member 66. Consequently, the developer G with a set toner concentration is supplied to the developing roller 64.

In the developing device 60, from the viewpoint of suppressing the difference in distribution of the developer G to be supplied to the developing sleeve 64B in the Z direction, it is not desirable that the first transport member 66 should be split in the Z direction. Meanwhile, the second transport member which supplies the developer G to the first transport member 66 does not directly supply the developer G to the developing sleeve 64B, and thus may be split in the Z direction.

In the developing device 60, the second transport member is split into the second transport member 68 and the second transport member 72, and the axial length of each of the second transport member 68 and the second transport member 72 is shorter than the axial length of the first transport member 66. The interval between a set of support points for each of the second transport member 68 and the second transport member 72 is shorter than the interval between a set of support points for the first transport member 66. This suppresses a warp of the second transport member 68 and the second transport member 72 at the center portion in the Z direction in the developing device 60 compared to a configuration in which the interval between a set of support points for each of the second transport member 68 and the second transport member 72 is substantially as long as the interval between a set of support points for the first transport member 66. The configuration in which the interval between a set of support points for each of the second transport member 68 and the second transport member 72 is substantially as long as the interval between a set of support points for the first transport member 66 means a configuration in which an end portion of the first flow path 78 and an end portion of the second flow path 82 do not overlap each other in the Z direction (as seen in the A direction).

Because a warp of the second transport member 68 and the second transport member 72 is suppressed, contact between the second transport member 68 and the wall surface of the first flow path 78, and contact between the second transport member 72 and the wall surface of the second flow path 82 are suppressed. Consequently, the developer G transported by the second transport member 68 and the second transport member 72 is unlikely to be pressurized by being caught between the second transport member 68 and the wall surface of the first flow path 78 and between the second transport member 72 and the wall surface of the second flow path 82.

In a comparative example in which the second flow path 82 is disposed farther from the first transport path 76 than the first flow path 78, the length of the flow path for return from the second flow path 82 to the first transport path 76 is longer than that in the developing device 60. The charge amount of the developer G transported to the first transport path 76 may be reduced, even if the toner T in the developer G is charged by stirring in the first flow path 78 and the second flow path 82, because the flow path from the second flow path 82 to the first transport path 76 is long and forced stirring is not performed.

In the developing device 60, on the other hand, the second flow path 82 is disposed closer to the first transport path 76 than the first flow path 78. Therefore, the length of the flow path for transport to the first transport path 76 after the toner T in the developer G is charged by stirring in the first flow path 78 and the second flow path 82 is shorter than that in the comparative example. That is, in the developing device 60, the charged state of the toner T is maintained better than in the comparative example, which suppresses a reduction in charge amount of the developer G transported to the first transport path 76.

Second Exemplary Embodiment

Next, a developing device and an image forming apparatus according to a second exemplary embodiment will be described. Members and portions that are basically the same in configuration as those according to the first exemplary embodiment discussed earlier are denoted by the same reference symbols as those used in the first exemplary embodiment to omit description thereof. The concept of being basically the same in configuration includes configurations that are the same in basic function although being partially different in length or shape.

Figure 6A:
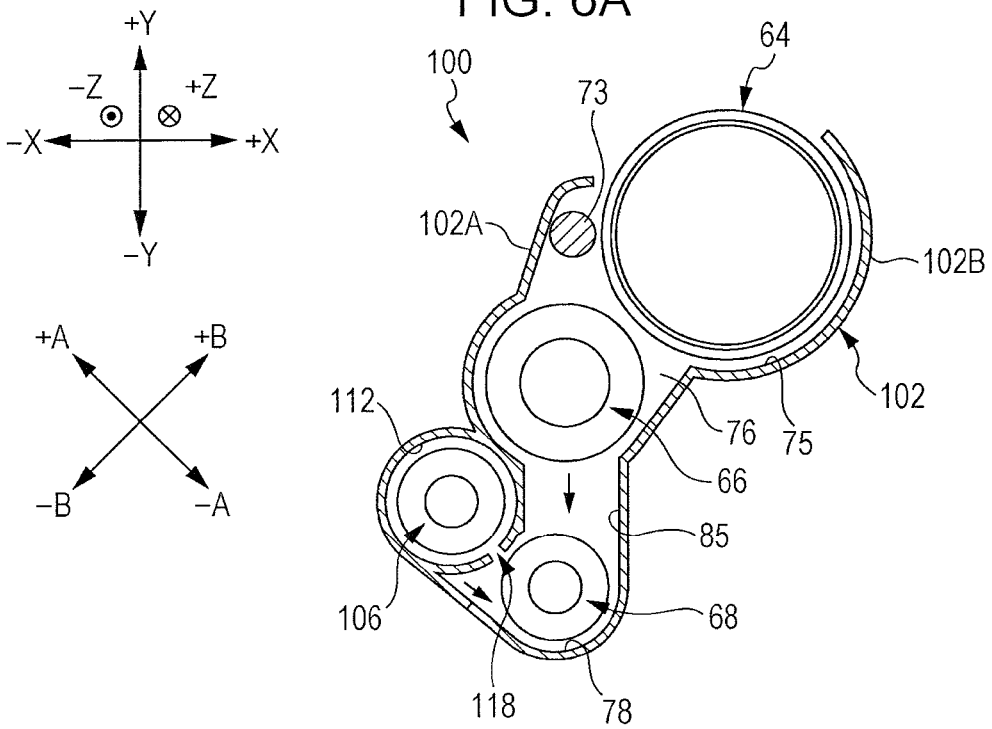
FIG. 6A is a vertical sectional view of the developing device according to the second exemplary embodiment (illustrating a section taken along the line VIA-VIA of FIG. 5)

FIG. 6A illustrates a developing device 100 according to the second exemplary embodiment. The developing device 100 is provided in the image forming apparatus 10 (see FIG. 1) according to the first exemplary embodiment in substitution for the developing device 60 (see FIG. 1). In addition, the developing device 100 includes a housing 102, the developing roller 64, the first transport member 66, the second transport member 68, a second transport member 104 (see FIG. 6B), a toner transport member 106, and the restriction member 73.

Figure 6B:
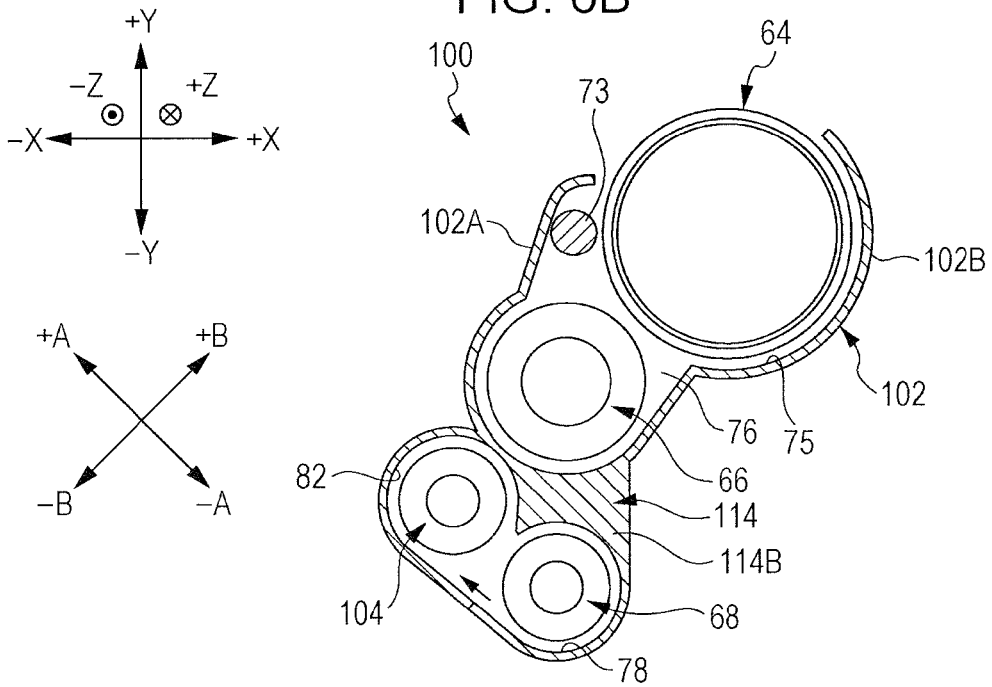
FIG. 6B is a vertical sectional view of the developing device according to the second exemplary embodiment (illustrating a section taken along the line VIB-VIB of FIG. 5)

In FIGS. 6A and 6B, the arrangement direction in which the first flow path 78 and the second flow path 82 to be discussed later are arranged is indicated by A direction, and the +Y side and the −Y side in the A direction are referred to as +A side and −A side, respectively. By way of example, the A direction is an oblique direction in which the +A side is on the −X side and the +Y side with respect to the −A side. Meanwhile, the direction which is orthogonal to the A direction and the Z direction is indicated as B direction. Further, the +Y side and the −Y side in the B direction are referred to as +B side and −B side, respectively.

<Housing>

As illustrated in FIG. 6B, the housing 102 includes an upper wall 102A and a lower wall 102B disposed on the +A side and the −A side, respectively, with respect to the developing roller 64, the first transport member 66, the second transport member 68, and the second transport member 104. An end portion of the upper wall 102A on the −B side is coupled to an end portion of the lower wall 102B on the −B side. The housing 102 also includes a side wall 102C on the +Z side and a side wall 102D on the −Z side (see FIG. 5) to be able to accommodate the developer G (see FIG. 2) inside.

Figure 5:
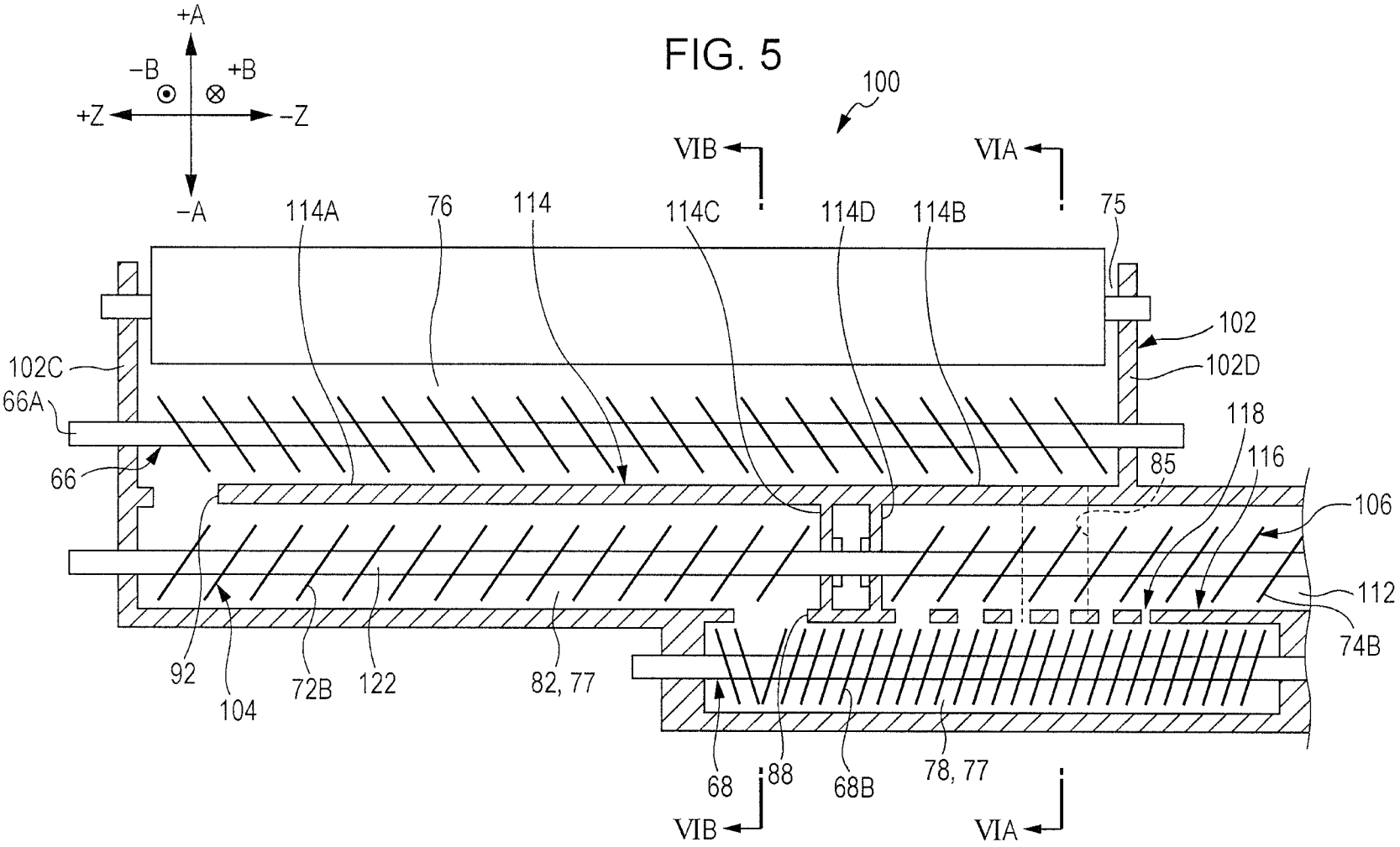
FIG. 5 is a side sectional view of a developing device according to a second exemplary embodiment.

The accommodation chamber 75, the first transport path 76, the first flow path 78, the second flow path 82, a toner supply path 112, and the connection path 85 are formed inside the housing 102 illustrated in FIG. 5. In addition, the first transport path 76, the first flow path 78, the second flow path 82, the toner supply path 112, and the connection path 85 are partitioned by partition walls 114 and 116. In the second exemplary embodiment, the accommodation chamber 75 and the first transport path 76 are not disposed along the A direction. In FIG. 5, however, the accommodation chamber 75 and the first transport path 76 are illustrated as disposed along the A direction in order to illustrate the arrangement of the members in an easily understandable manner.

The accommodation chamber 75 is formed between the side wall 102C and the side wall 102D which are provided on the +A side of the housing 102 and which oppose each other in the Z direction. The first transport path 76 is formed on the −A side with respect to the accommodation chamber 75, and extends along the Z direction from the side wall 102C to the side wall 102D. The partition wall 114 is formed on the −A side with respect to the first transport path 76.

The partition wall 114 is provided between the side wall 102C and the side wall 102D and at the center portion in the A direction to extend in the Z direction. In addition, the partition wall 114 includes a plate-like first wall portion 114A that extends from the center portion in the Z direction to a location near the side wall 102C, and a second wall portion 114B that is wider in the A direction than the first wall portion 114A and that extends from an end portion of the first wall portion 114A on the −Z side to a location near the side wall 102D. A surface of the first wall portion 114A on the +A side and a surface of the second wall portion 114B on the +A side are flush with each other in the Z direction. In addition, the second wall portion 114B extends toward the +B side.

Inner walls 114C and 114D are formed on a side surface of the partition wall 114 on the −A side to swell in a plate shape from the side surface on the −A side toward the −A side and oppose each other in the Z direction. In addition, the connection path 85 is formed on the −Z side with respect to the second wall portion 114B of the partition wall 114. The connection path 85 is disposed on the +B side with respect to the toner supply path 112 as the housing 102 is seen in the B direction.

The first flow path 78 is provided on the −A side with respect to the second wall portion 114B to extend along the Z direction. An end portion of the first flow path 78 on the +Z side extends to a location on the +Z side with respect to the second wall portion 114B as seen in the A direction. In addition, an end portion of the first flow path 78 on the −Z side extends to a location on the −Z side with respect to the side wall 102D as seen in the A direction. Further, a third opening portion 118 that serves as an example of an opening portion that penetrates in the A direction is formed in the partition wall 116 which is formed at an end portion of the first flow path 78 on the −Z side and on the +A side. The third opening portion 118 overlaps the first flow path 78 in the Z direction (as seen in the A direction). An end portion of the second flow path 82 on the +Z side extends to the side wall 102C.

The toner supply path 112 extends along the Z direction toward the −Z side from a position on the +A side with respect to the third opening portion 118 and on the −Z side with respect to the connection path 85. In addition, the toner supply path 112 is provided on the side closer to the first transport path 76 with respect to the first flow path 78 and disposed at substantially the same position as the second flow path 82 as seen in the Z direction. A toner transport member 106 is disposed inside the toner supply path 112. The toner transport member 106 will be discussed later.

(Third Opening Portion)

Figure 7:
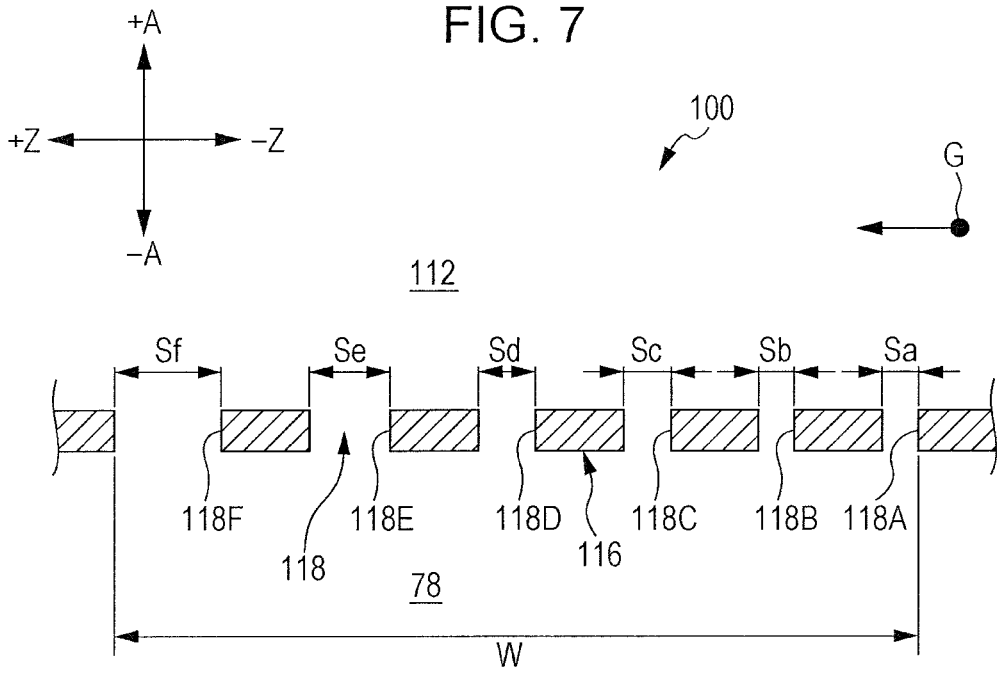
FIG. 7 illustrates a third opening portion of the developing device according to the second exemplary embodiment.

As illustrated in FIG. 7, by way of example, the third opening portion 118 includes hole portions 118A, 118B, 118C, 118D, 118E, and 118F disposed at intervals in the Z direction to penetrate the partition wall 116 in the A direction. By way of example, the hole portions 118A, 118B, 118C, 118D, 118E, and 118F are formed in a rectangular shape as seen in the A direction, and arranged in this order from the −Z side (upstream side in the Z direction in which the toner T flows) toward the +Z side (downstream side).

When the opening areas of the hole portions 118A, 118B, 118C, 118D, 118E, and 118F are defined as Sa, Sb, Sc, Sd, Se, and Sf, respectively, Sa<Sb<Sc<Sd<Se<Sf is met. That is, the opening areas of the hole portions 118A, 118B, 118C, 118D, 118E, and 118F are smaller on the upstream side than on the downstream side. For the third opening portion 118, further, the width W in the Z direction from the wall surface of the hole portion 118A on the −Z side to the wall surface of the hole portion 118F on the +Z side is determined to be equal to or more than twice the pitch P1 of the spiral blade portion 68B (see FIG. 5) of the second transport member 68. The width W is the width over which the third opening portion 118 overlaps the first flow path 78 as seen in the A direction, and the width of a portion of the third opening portion 118 that is connected to the first flow path 78.

<Second Transport Member>

As illustrated in FIG. 5, the second transport member 104 includes a shaft portion 122 having an axis extending in the Z direction, and the spiral blade portion 72B formed on the outer periphery of the shaft portion 122. The shaft portion 122 is provided to extend over the second flow path 82 and the toner supply path 112. That is, the shaft portion 122 is rotatably supported by the side wall 102C, the inner walls 114C and 114D, and a side wall (not illustrated) of the toner supply path 112 on the −Z side. The length of the shaft portion 122 in the second flow path 82 in the Z direction is shorter than the length of the shaft portion 66A in the Z direction. The second transport member 104 transports the developer G toward the +Z side when the shaft portion 122 is rotated.

By way of example, the outside diameter of the second transport member 68 and the outside diameter of the second transport member 104 are substantially the same as each other. In addition, by way of example, the outside diameter of the second transport member 68 and the outside diameter of the second transport member 104 are each smaller than the outside diameter of the first transport member 66. The second transport member 104 has a pitch P2, a projected area S2 in the Z direction, and a rotational speed R2.

<Toner Transport Member>

As illustrated in FIG. 5, the toner transport member 106 includes the shaft portion 122 which extends along the Z direction, and the spiral blade portion 74B formed on the outer periphery of the shaft portion 122. That is, the toner transport member 106 and the second transport member 104 are disposed coaxially with each other. In addition, the toner transport member 106 and the second transport member 104 are rotated about their own axes by rotationally driving a gear (not illustrated) provided at an end portion in the axial direction using a motor (not illustrated).

[Effect]

Next, the effect of the second exemplary embodiment will be described.

Figure 8:
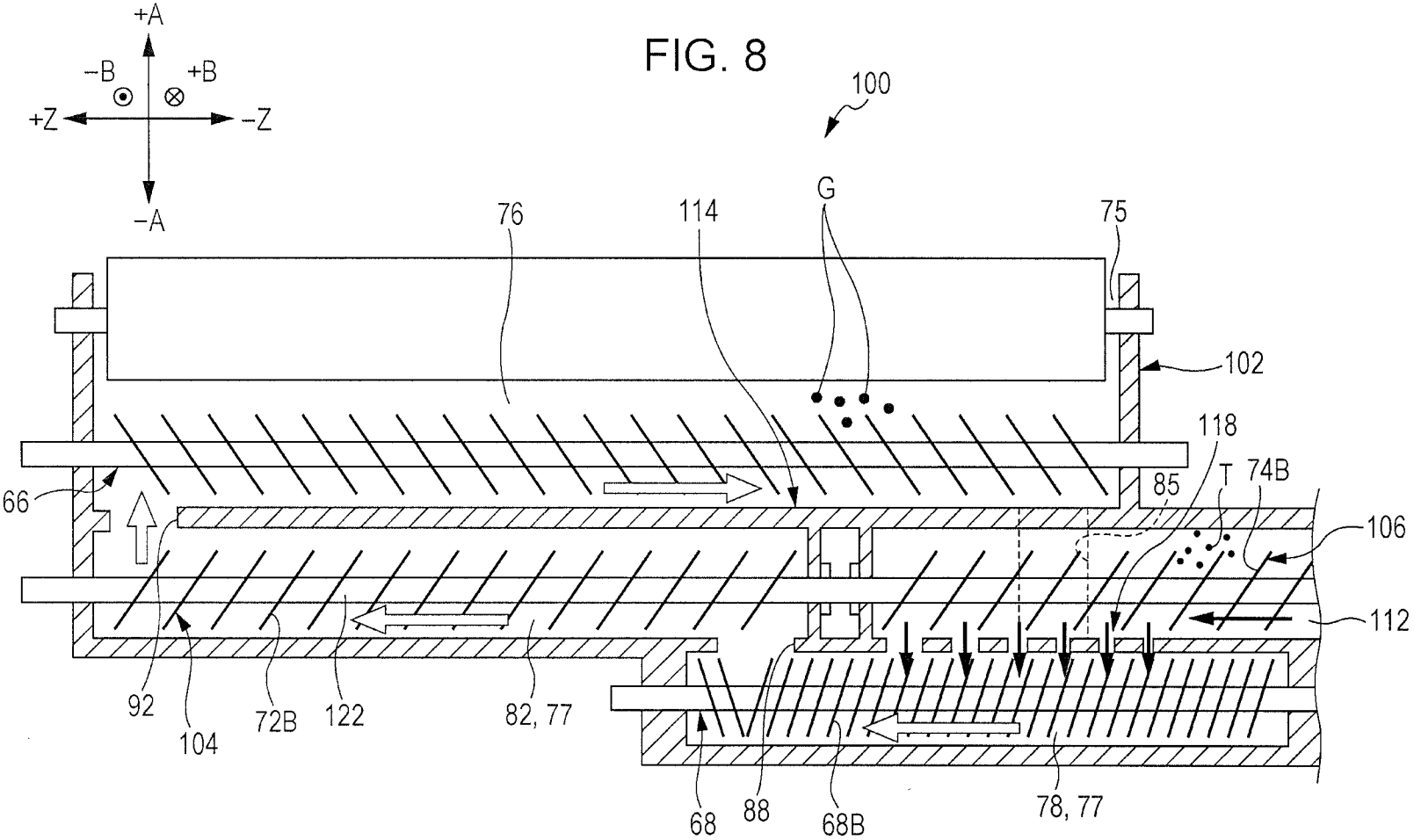
FIG. 8 illustrates the flow of a developer and toner inside the developing device according to the second exemplary embodiment.

In the developing device 100 illustrated in FIG. 8, the developer G is stirred and transported in the order of the first transport path 76, the connection path 85, the first flow path 78, the first opening 88, the second flow path 82, the second opening 92, and the first transport path 76. In addition, the toner T in the toner supply path 112 passes through the third opening portion 118 to flow into (be supplied to) the first flow path 78. In the first flow path 78, the developer G with a reduced toner concentration and the supplied toner T are stirred and transported toward the +Z side by rotation of the second transport member 68. In FIG. 8, the flow of the developer G is indicated by the white arrows, and the flow of the toner T is indicated by the black arrows.

In the developing device 100, the second transport member is split into the second transport member 68 and the second transport member 104, and the interval between a set of support points for the second transport member 104 is shorter than the interval between a set of support points for the first transport member 66. This suppresses a warp of the second transport member 104 at the center portion in the Z direction in the developing device 100 compared to a configuration in which the interval between a set of support points for the second transport member 104 is substantially as long as the interval between a set of support points for the first transport member 66.

Because a warp of the second transport member 104 is suppressed, contact between the second transport member 104 and the wall surface of the second flow path 82 is suppressed. Therefore, the developer G transported by the second transport member 104 is unlikely to be pressurized by being caught between the second transport member 104 and the wall surface of the second flow path 82.

In the developing device 100, in addition, the width W (see FIG. 7) of the third opening portion 118 in the Z direction is determined to be equal to or more than twice the pitch P1 (not illustrated) of the spiral blade portion 68B of the second transport member 68. Therefore, concentrated supply of the toner T to a region of the second transport member 68 corresponding to one pitch of the spiral blade portion 68B is suppressed, and the toner T is supplied over a wide range of the second transport member 68 in the Z direction to be stirred together with the developer G. Consequently, the difference in toner concentration in the developer G in the first flow path 78 in the Z direction is reduced compared to a configuration in which the width W is shorter than twice the pitch of the spiral blade portion 68B in the Z direction.

In the developing device 100, further, as illustrated in FIG. 7, the opening areas Sa, Sb, Sc, Sd, Se, and Sf of the hole portions 118A, 118B, 118C, 118D, 118E, and 118F, respectively, are smaller on the upstream side in the direction (transport direction) in which the toner T flows than on the downstream side. Therefore, on the upstream side in the transport direction, a small amount of the toner T falls down to be supplied, and the rest of the toner T is transported toward the downstream side. As the toner T is transported toward the downstream side in the transport direction, in addition, a larger amount of the toner T falls down to be supplied. Consequently, the supplied toner T is distributed widely in the transport direction, which allows the toner T to be easily distributed in the Z direction compared to a configuration in which the opening areas of the plural hole portions are larger on the upstream side in the direction in which the toner T flows than on the downstream side.

In the developing device 100, moreover, as illustrated in FIG. 8, the toner transport member 106 and the second transport member 104 are disposed coaxially with each other (share the shaft portion 122). Consequently, the installation space for the developing device 100 is reduced compared to a configuration in which the toner transport member 106 and the second transport member 104 are disposed as displaced in the A direction.

Third Exemplary Embodiment

Next, a developing device and an image forming apparatus according to a third exemplary embodiment will be described. Members and portions that are basically the same in configuration as those according to the first and second exemplary embodiments discussed earlier are denoted by the same reference symbols as those used in the first and second exemplary embodiments to omit description thereof.

Figure 9:
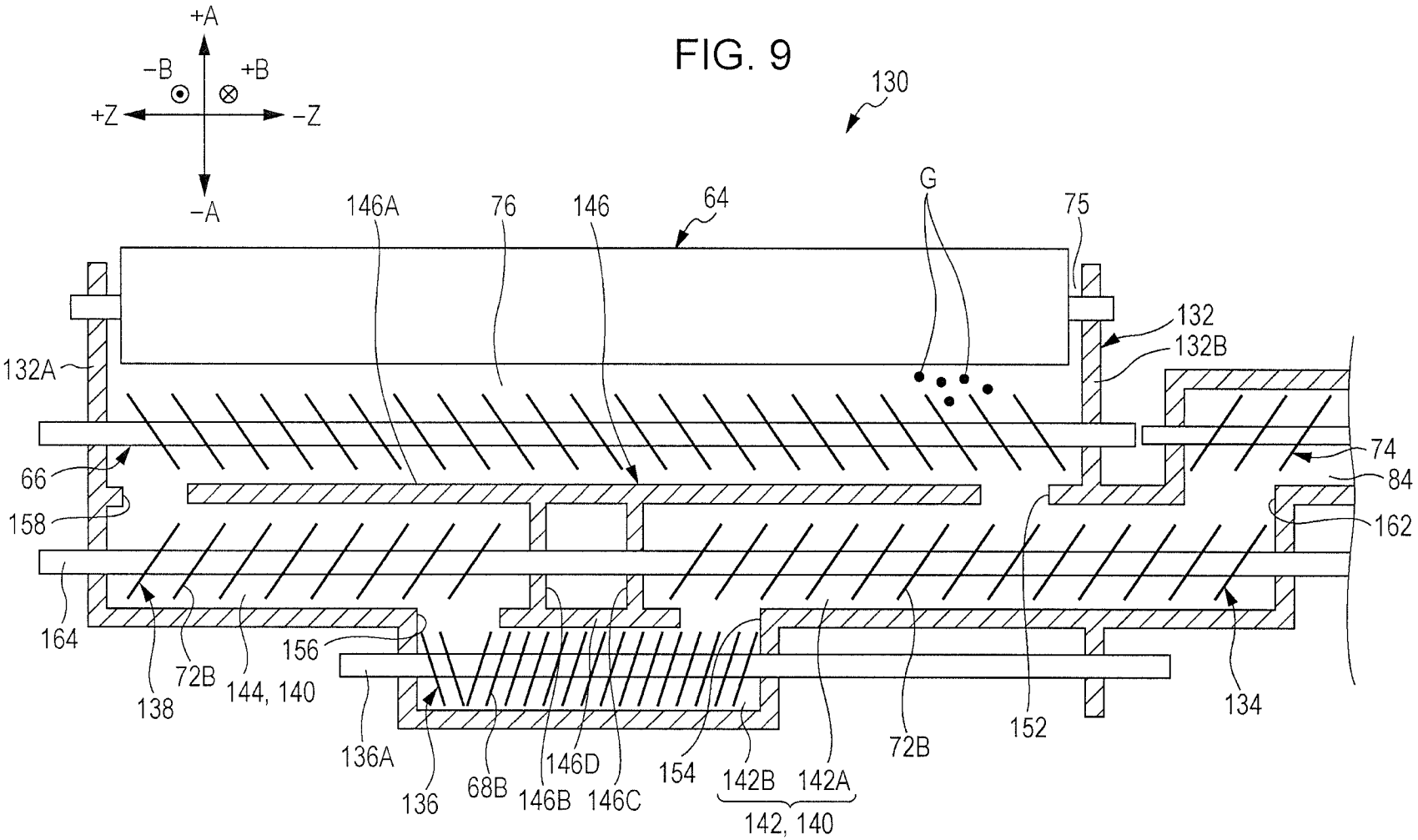
FIG. 9 is a side sectional view of a developing device according to a third exemplary embodiment.

FIG. 9 illustrates a developing device 130 according to the third exemplary embodiment. The developing device 130 is provided in the image forming apparatus 10 (see FIG. 1) according to the first exemplary embodiment in substitution for the developing device 60 (see FIG. 1). In addition, the developing device 130 includes a housing 132, the developing roller 64, the first transport member 66, second transport members 134, 136, and 138, the toner transport member 74, and the restriction member 73 (see FIG. 2).

<Housing>

The accommodation chamber 75, the first transport path 76, a second transport path 140, and the toner supply path 84 are formed inside the housing 132. In addition, the first transport path 76 and the second transport path 140 are partitioned by a partition wall 146. The second transport path 140 includes a first flow path 142 and a second flow path 144 that serve as an example of plural flow paths. The housing 132 includes an upper wall on the −B side and a lower wall on the +B side (not illustrated).

The accommodation chamber 75 is formed between a side wall 132A and a side wall 132B that are provided on the +A side of the housing 132 and that oppose each other in the Z direction. The first transport path 76 is formed on the −A side with respect to the accommodation chamber 75, and extends along the Z direction from the side wall 132A to the side wall 132B. The partition wall 146 is formed on the −A side with respect to the first transport path 76.

The partition wall 146 is provided between the side wall 132A and the side wall 132B and at the center portion in the A direction to extend in the Z direction. In addition, the partition wall 146 includes a first wall portion 146A that extends along the Z direction, a second wall portion 146B and a third wall portion 146C that project toward the −Z side from the center portion of the first wall portion 146A in the Z direction, and a fourth wall portion 146D that extends in the Z direction to couple between the second wall portion 146B and the third wall portion 146C.

A first opening 152 that penetrates in the A direction is formed on the −Z side with respect to the first wall portion 146A. A fourth opening 158 that penetrates in the A direction is formed on the +Z side with respect to the first wall portion 146A. A second opening 154 that penetrates in the A direction is formed on the −Z side with respect to the fourth wall portion 146D. A third opening 156 that penetrates in the A direction is formed on the +Z side with respect to the fourth wall portion 146D.

(First Flow Path)

The first flow path 142 includes an upstream flow path 142A into which the developer G flows from the first transport path 76, and a downstream flow path 142B into which the developer G flows from the upstream flow path 142A and from which the developer G flows into the second flow path 144.

The upstream flow path 142A is shorter in length in the Z direction than the first transport path 76, and is disposed on the −Z side and the −A side with respect to the center portion of the first transport path 76 in the Z direction. The first opening 152 connects between an end portion of the first transport path 76 on the −Z side and the center portion of the upstream flow path 142A in the Z direction. In addition, the second opening 154 discussed already is formed in a wall at an end portion of the upstream flow path 142A on the +Z side and on the −A side. Further, a fifth opening 162 that connects between the toner supply path 84 and the upstream flow path 142A is formed in a wall at an end portion of the upstream flow path 142A on the −Z side and on the +A side.

The downstream flow path 142B is shorter in length in the Z direction than the upstream flow path 142A, and is disposed on the +Z side with respect to the center portion of the upstream flow path 142A in the Z direction and on the −A side. The second opening 154 connects between an end portion of the upstream flow path 142A on the −Z side and an end portion of the downstream flow path 142B on the +Z side. That is, an end portion of the upstream flow path 142A on the +Z side and an end portion of the downstream flow path 142B on the −Z side overlap each other as seen in the A direction. In addition, the upstream flow path 142A is disposed closer to the first transport path 76 than the downstream flow path 142B. The third opening 156 discussed already is formed in a wall at an end portion of the downstream flow path 142B on the +Z side and on the +A side.

(Second Flow Path)

The second flow path 144 is shorter in the Z direction than the upstream flow path 142A, and longer in the Z direction than the downstream flow path 142B. In addition, the second flow path 144 is disposed on the −A side with respect to the first transport path 76 and on the +A side with respect to the downstream flow path 142B. Further, the second flow path 144 is disposed side by side with the upstream flow path 142A in the Z direction. The third opening 156 connects between an end portion of the downstream flow path 142B on the +Z side and an end portion of the second flow path 144 on the +Z side. That is, an end portion of the downstream flow path 142B on the +Z side and an end portion of the second flow path 144 on the −Z side overlap each other as seen in the A direction. In addition, the fourth opening 158 discussed already is formed in a wall at an end portion of the second flow path 144 on the +Z side and on the +A side.

<Second Transport Member>

As illustrated in FIG. 9, the second transport member 134 is rotatably disposed in the upstream flow path 142A with an axis extending in the Z direction. The second transport member 136 is rotatably disposed in the downstream flow path 142B with an axis extending in the Z direction. The second transport member 138 is rotatably disposed in the second flow path 144 with an axis extending in the Z direction.

The second transport member 134 and the second transport member 138 have a common shaft portion 164. In addition, the second transport member 134 and the second transport member 138 each have the spiral blade portion 72B. Further, the second transport member 134 and the second transport member 138 each have a pitch P2, a projected area S2 in the Z direction, and a rotational speed R2.

The second transport member 136 includes a shaft portion 136A having an axis extending in the Z direction, and a spiral blade portion 68B formed on the outer periphery of the shaft portion 136A. The second transport member 136 has a pitch P1, a projected area S1 in the Z direction, and a rotational speed R1.

[Effect]

Next, the effect of the third exemplary embodiment will be described.

Figure 10:
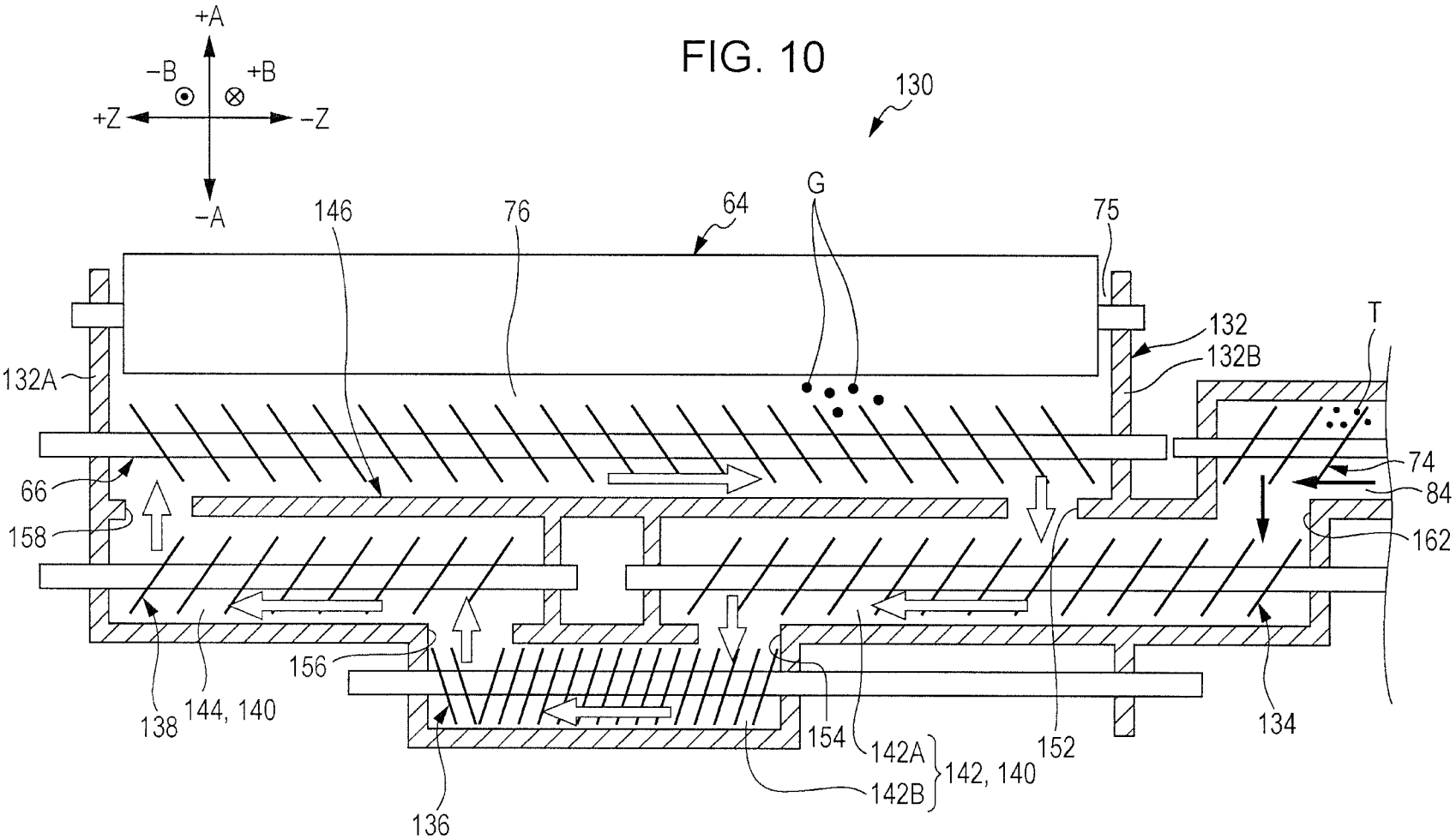
FIG. 10 illustrates the flow of a developer and toner inside the developing device according to the third exemplary embodiment.

In the developing device 130 illustrated in FIG. 10, the developer G is stirred and transported in the order of the first transport path 76, the first opening 152, the upstream flow path 142A, the second opening 154, the downstream flow path 142B, the third opening 156, the second flow path 144, the fourth opening 158, and the first transport path 76. In addition, the toner T in the toner supply path 84 flows into (is supplied to) the upstream flow path 142A through the fifth opening 162. In the upstream flow path 142A, the developer G with a reduced toner concentration and the supplied toner T are stirred and transported toward the +Z side by rotation of the second transport member 134. In FIG. 10, the flow of the developer G is indicated by the white arrows, and the flow of the toner T is indicated by the black arrows.

In the developing device 130, the second transport member is split into the second transport members 134, 136, and 138, and the interval between a set of support points for each of the second transport members 134, 136, and 138 is shorter than the interval between a set of support points for the first transport member 66. This suppresses a warp of each of the second transport members 134, 136, and 138 at the center portion in the Z direction in the developing device 130 compared to a configuration in which the interval between a set of support points for the second transport members 134, 136, and 138 is substantially as long as the interval between a set of support points for the first transport member 66.

Because a warp of the second transport members 134, 136, and 138 is suppressed, contact between the second transport members 134, 136, and 138 and the wall surfaces of the upstream flow path 142A, the downstream flow path 142B, and the second flow path 144 is suppressed. Therefore, the developer G transported by the second transport members 134, 136, and 138 is unlikely to be pressurized by being caught between the second transport members 134, 136, and 138 and the wall surfaces of the upstream flow path 142A, the downstream flow path 142B, and the second flow path 144.

In the developing device 130, in addition, the first flow path 142 is split into the upstream flow path 142A and the downstream flow path 142B, which are disposed as displaced in the A direction. Thus, the path through which the developer G is stirred and transported is lengthened compared to a configuration in which a single first flow path is provided in the Z direction. Further, the direction of the flow of the developer G is changed at a portion at which the upstream flow path 142A and the downstream flow path 142B are connected to each other as displaced, which enhances the stirring action for the developer G. This increases the charge amount of the developer G compared to a configuration in which the first flow path 142 does not include the upstream flow path 142A and the downstream flow path 142B.

The present invention is not limited to the exemplary embodiments described above.

Figure 11A:
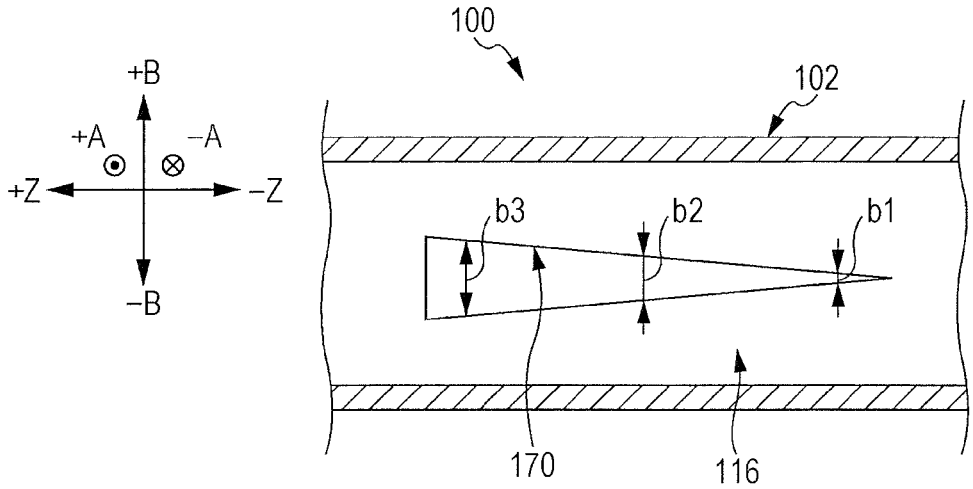
FIGS. 11A and 11B illustrate modifications of the third opening portion of the developing device according to the second exemplary embodiment.
Figure 11B:
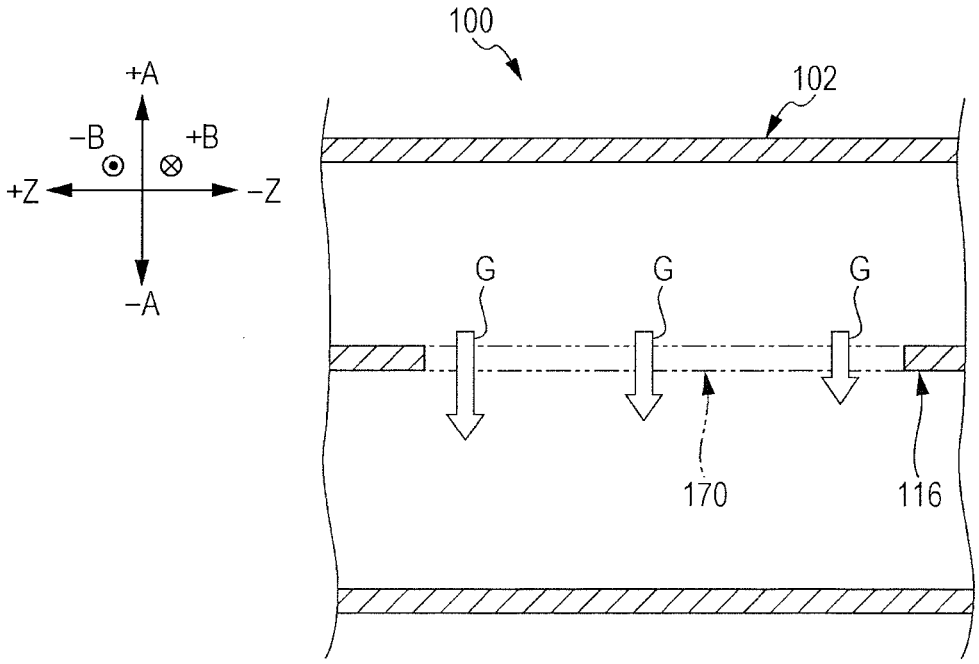

In the housing 102 of the developing device 100 according to the second exemplary embodiment illustrated in FIG. 5, a single hole portion 170 that serves as an example of an opening portion illustrated in FIGS. 11A and 11B may be formed in place of the third opening portion 118. The single hole portion 170 is formed in the shape of a wedge with an opening width that becomes wider from the upstream side (−Z side) in the Z direction in which the developer G flows toward the downstream side (+Z side) as seen in the A direction. Specifically, when the width in the B direction is defined as b1, b2, and b3 sequentially from the upstream side in the Z direction, b1<b2<b3 is met. That is, the opening area is smaller on the upstream side in the direction in which the toner T flows than on the downstream side. Therefore, on the upstream side in the transport direction (Z direction), a small amount of the toner T falls down to be supplied, and the rest of the toner T is transported toward the downstream side.

As the toner T is transported toward the downstream side in the transport direction in addition, a larger amount of the toner T falls down through the single hole portion 170 to be supplied. Consequently, the supplied toner T is distributed widely in the transport direction, which allows the developer G to be easily distributed in the Z direction compared to a configuration in which the opening width of the single hole portion 170 on the upstream side in the direction in which the developer G flows is the same as the opening width on the downstream side.

In the developing devices 60, 100, and 130, the A direction may coincide with the Y direction, and the B direction may coincide with the X direction. In addition, the number of the plural flow paths of the second transport path is not limited to two or three and may be four or more, and there may be three or more sets of end portions of the flow paths to be connected.

In the case where the developer G returned to the first transport path 76 is less affected by the length of the flow path from the second flow path 82 to the first transport path 76 and the direction of the gravitational force which acts on the developer G in the developing device 60, the second flow path 82 may be disposed farther from the first transport path 76 with respect to the first flow path 78. In the developing device 60, in addition, the rotational speed of the second transport member 68 may be higher than the rotational speed of the second transport member 72.

In the developing device 100, the upstream flow path 142A may be disposed farther from the first transport path 76 than the downstream flow path 142B. In the developing device 100, in addition, the width W of the third opening portion 118 may be shorter than twice the pitch P1 of the spiral blade portion 68B of the second transport member 68. In the developing device 100, further, the opening areas of the hole portions 118A, 118B, 118C, 118D, 118E, and 118F may be equal to each other, or may be varied at random in the Z direction.

In the developing device 100, moreover, the number of the hole portions is not limited to six, and may be one to five or seven or more. In the developing device 100, in addition, the second transport member 104 and the toner transport member 106 may be disposed as separate members. That is, the second transport member 104 and the toner transport member 106 may be provided as separate members as long as the second transport member 104 and the toner transport member 106 are disposed such that their respective shaft portions at least partially overlap each other as seen in the Z direction.

In the developing device 130, the upstream flow path 142A may be disposed farther from the first transport path 76 than the downstream flow path 142B.

The configuration of the developing device is not limited to those of the developing devices 60, 100, and 130, and members of the developing devices 60, 100, and 130 may be combined with each other. It is a matter of course that the present invention may be implemented in a variety of forms without departing from the scope and spirit of the present invention.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a first transport path in which a developer containing toner and a magnetic material is transported in an axial direction of a first transport member that opposes a developer holding element by rotation of the first transport member; and a second transport path including a plurality of flow paths that extend along the axial direction and a plurality of second transport members provided in the plurality of flow paths to transport the developer, the plurality of flow paths each having a length in the axial direction that is shorter than a length of the first transport path in the axial direction, and respective end portions of the first transport path and the second transport path being connected such that the developer which has flowed into the second transport path from one end of the first transport path flows into another end of the first transport path.

2. The developing device according to claim 1, wherein the second transport path includes a first flow path into which the developer flows from the one end of the first transport path, and a second flow path from which the developer flows into the other end of the first transport path, the second transport member includes a rotatably supported shaft portion and a blade portion formed spirally on the shaft portion, an interval of the blade portion of the second transport member in the first flow path is shorter than an interval of the blade portion of the second transport member in the second flow path, and a rotational speed of the second transport member in the first flow path is higher than a rotational speed of the second transport member in the second flow path.

3. The developing device according to claim 2, wherein the first flow path includes an upstream flow path into which the developer flows from the first transport path, and a downstream flow path into which the developer flows from the upstream flow path and from which the developer flows into the second flow path, the upstream flow path being disposed closer to the first transport path than the downstream flow path.

4. The developing device according to claim 1, wherein a toner supply path to which the toner is supplied is connected to one of the flow paths of the second transport path via an opening portion, the second transport member in the flow path to which the toner supply path is connected includes the rotatably supported shaft portion and the blade portion formed spirally on the shaft portion, and a width of the opening portion is determined to be equal to or more than twice a pitch of the blade portion in the axial direction.

5. The developing device according to claim 4, wherein the opening portion includes a plurality of hole portions disposed at intervals in the axial direction, and opening areas of the plurality of hole portions are smaller on an upstream side in a direction in which the developer in the toner supply path flows than on a downstream side.

6. The developing device according to claim 4, wherein the opening portion includes a single wedge-shaped hole portion, an opening width of the hole portion on an upstream side in a direction in which the developer flows being smaller than an opening width of the hole portion on a downstream side.

7. The developing device according to claim 4, wherein a toner transport member that transports the toner in the axial direction is provided in the toner supply path, and the toner transport member and one of the plurality of second transport members are disposed so as to overlap each other as seen in the axial direction.

8. An image forming apparatus comprising:

an image holding element that holds a latent image;

the developing device according to claim 1 which develops the latent image on the image holding element using the developer to form a developer image; and a transfer unit that transfers the developer image to a storage medium.

* * * * *